US009204520B2

(12) United States Patent
Magg

(10) Patent No.: US 9,204,520 B2
(45) Date of Patent: Dec. 1, 2015

(54) METHOD FOR OPERATING A HIGH-PRESSURE DISCHARGE LAMP OUTSIDE THE NOMINAL POWER RANGE THEREOF

(75) Inventor: Norbert Magg, Berlin (DE)

(73) Assignee: OSRAM GmbH, Munich (DE)

( * ) Notice: Subject to any disclaimer, the term of this patent is extended or adjusted under 35 U.S.C. 154(b) by 350 days.

(21) Appl. No.: 13/814,268

(22) PCT Filed: Aug. 1, 2011

(86) PCT No.: PCT/EP2011/063198

§ 371 (c)(1),
(2), (4) Date: Feb. 5, 2013

(87) PCT Pub. No.: WO2012/019935

PCT Pub. Date: Feb. 16, 2012

(65) Prior Publication Data

US 2013/0134899 A1 May 30, 2013

(30) Foreign Application Priority Data

Aug. 11, 2010 (DE) ..... 10 2010 039 221

(51) Int. Cl.

| | |
|---|---|
| ***G05F 1/00*** | (2006.01) |
| ***H05B 37/02*** | (2006.01) |
| ***H05B 41/292*** | (2006.01) |

(52) U.S. Cl.

CPC ..... *H05B 37/02* (2013.01); *H05B 41/2928* (2013.01)

(58) Field of Classification Search

None

See application file for complete search history.

(56) References Cited

U.S. PATENT DOCUMENTS

| | | | | |
|---|---|---|---|---|
| 5,917,558 | A | 6/1999 | Stanton | |
| 6,069,456 | A * | 5/2000 | Fromm et al. | 315/248 |
| 6,586,892 | B2 | 7/2003 | Derra et al. | |
| 7,274,157 | B2 | 9/2007 | Hirata et al. | |
| 8,008,868 | B2 | 8/2011 | Yamauchi | |
| 2004/0000880 | A1 | 1/2004 | Ozasa et al. | |
| 2009/0167211 | A1 * | 7/2009 | Deppe | 315/307 |
| 2010/0033692 | A1 | 2/2010 | Watanabe et al. | |
| 2010/0264848 | A1 * | 10/2010 | Deppe et al. | 315/307 |

FOREIGN PATENT DOCUMENTS

| | | | |
|---|---|---|---|
| EP | 1152645 | A1 | 11/2001 |
| JP | 2005100786 | A | 4/2005 |
| JP | 2006286460 | A | 10/2006 |
| JP | 2008270058 | A | 11/2008 |
| JP | 2010055840 | A | 3/2010 |
| WO | 0036882 | A1 | 6/2000 |

* cited by examiner

*Primary Examiner* — Cassandra Cox

(57) ABSTRACT

A method for operating a high-pressure discharge lamp outside the nominal power range thereof is provided. The method may include: providing the high-pressure discharge lamp; and varying relative to operation at nominal power, one of at a lamp power of less than 85% of the nominal power and at a lamp power of greater than 110% of the nominal power at least one or more of the following parameters: lamp frequency, lamp current in a commutation pulse, length of the commutation pulse, and the commutation pattern.

12 Claims, 4 Drawing Sheets

METHOD FOR OPERATING A HIGH-PRESSURE DISCHARGE LAMP OUTSIDE THE NOMINAL POWER RANGE THEREOF

RELATED APPLICATIONS

The present application is a national stage entry according to 35 U.S.C. §371 of PCT application No.: PCT/EP2011/063198 filed on Aug. 1, 2011, which claims priority from German Application No.: 10 2010 039 221.9 filed on Aug. 11, 2010.

TECHNICAL FIELD

Various embodiments relate to a method for operating high-pressure discharge lamps, e.g. high- and extremely-high-pressure discharge lamps, such as are used in devices for projecting images, outside the nominal power range thereof. Various embodiments are concerned, for example, with the problem of flicker phenomena caused by the operation of said discharge lamps outside the nominal power range thereof.

BACKGROUND

Various embodiments are based on a method for operating a high-pressure discharge lamp outside the nominal power range thereof.

During the operation of discharge lamps, which are also called lamps for short hereinafter, there is the problem of the stable arc attachment of the discharge arc on the electrode tips. Under certain operating conditions, the discharge arc jumps from one arc attachment point to another. This jumping of the discharge point is also referred to as arc jumping and is manifested in lamp flickering. This is particularly disturbing if the light from the lamp is used for projecting images.

Projection devices such as video projectors often use so-called ultra short arc lamps on account of the prerequisites for the optical imaging. Said lamps are high-pressure discharge lamps which have a very short electrode spacing in order to be able to ensure a good optical imaging of the video projector. On account of the high power of these lamps and the short electrode spacing, the electrodes become very hot. Therefore, simple pin electrodes cannot be used in these types of lamps. Instead, use is made of electrodes having a very wide electrode head in order to increase their thermal mass. In this case, the head diameter is typically greater than the electrode spacing (e.g. head diameter of 1.5 mm in a lamp having an electrode spacing of 1.0 mm).

Hereinafter, the term electrode end denotes the inner end of the lamp electrode projecting into the discharge space of the gas discharge lamp burner. The term electrode tip denotes a needle- or lug-shaped elevation which is seated on the electrode end and the end of which serves as an attachment point for the arc.

EP 1 152 645 discloses a method which allows electrode tips to grow on the electrode by means of current pulses, also called maintenance pulses hereinafter. These grown electrode tips initially have the advantage that the plasma arc of the arc discharge generated in the lamp finds a stable attachment point on the electrode and does not jump between a plurality of attachment points. What is crucial in this case is the ability of the electrode to be able to supply a sufficiently high current, which depends crucially on the temperature of said electrode. If said temperature is too low, the tip of the electrode is not liquid, and the arc attachment is unsatisfactory on an electrode tip that is not at least partly liquid. An excessively cold tip leads to solidification of the liquid tungsten and the arc thereupon contracts, that is to say that a punctiform arc attachment occurs, because the energy density is increased as a result. However, said punctiform arc attachment is unstable and readily moves over the electrode tip, which can be perceived as flicker in the application. Moreover, a moving arc attachment, on account of the high energy density, leads to undesired changes in the front region of the electrode head. Video projectors often require a light source which has a temporal sequence of different colors. As is described in the document U.S. Pat. No. 5,917,558 (Stanton), this can be achieved by means of a rotating color wheel, for example, which filters changing colors from the light of the lamp. The time durations during which the light assumes a specific color need not necessarily be identical. Rather, a desired color temperature that arises for the projected light can be set by means of the ratio of said time durations with respect to one another.

The lamp is usually operated with a rectangular lamp current. The lamp frequency is understood to be the reciprocal of the period duration of the rectangular lamp current, as illustrated in FIG. 1. The lamp frequency at nominal power is understood to be the reciprocal of the period duration of the rectangular lamp current during operation of the lamp with nominal power. The nominal power is the power with which the lamp should be operated, as specified by the lamp manufacturer. At nominal power, the high-pressure discharge lamp is usually operated with a predetermined frequency. In the prior art, the lamp current is generated from a DC source with the aid of a commutation device. The commutation device usually consists of electronic switches which commutate the polarity of the DC source with the timing of the rectangular lamp current. During commutation, overshoots cannot be completely avoided in practice. Therefore, in the prior art the point in time at which a commutation is intended to take place is combined with the point in time at which the color of the light changes in order to mask out the overshoots. For this purpose, a sync signal is provided, which includes a sync pulse synchronously with the abovementioned color wheel. The color change and the commutation of the lamp current are synchronized with the aid of the sync signal. In advanced projection systems, the lamp current need not always exhibit a rectangular shape, rather the current level can proceed in a plurality of steps. This current profile over time is also designated hereinafter as the "waveform". An explanation of the term will be found further below.

During the operation of discharge lamps there is the phenomenon of the growth of electrode tips which, as explained above, represent an essential prerequisite for a stable arc attachment. Material which evaporates from the electrodes at a location is deposited again at preferred locations on the electrode and can in this case contribute to the formation of electrode tips. Furthermore, as a result of the repeated melting and solidification of the tungsten at the electrode tip, tungsten material from electrode regions situated further back is transported into the tip of the electrode. These transport phenomena are greatly dependent on the temperature of the electrode, and also the changes in said temperature with respect to time and hence the operating mode of the lamp. The growth of the electrode tips can be caused e.g. by so-called "maintenance pulses", which are also designated as commutation pulses hereinafter. These are short current pulses, usually shortly before the commutation, which have an increased current magnitude.

FIG. 1 shows an example of such a commutation pulse in a very simple waveform. The waveform is divided into a plateau and the commutation pulse. The plateau is described by a plateau length and a plateau height i.e. by a specific residence time of a current magnitude. The commutation pulse is likewise described by a pulse length and a pulse height i.e. by the duration of the pulse at a specific current magnitude. The commutation pulse provides for greater melting of the electrode in the front region, which is then contracted by the surface tension of the tungsten and subsequently cools again after the commutation pulse and the subsequent commutation. If this method is repeated at corresponding time intervals, a tip slowly forms from this. In this case, the commutation pulse should always precede the commutation for an effective application.

FIG. 2A shows a further example of a waveform having a further current boost alongside the commutation pulse. In this case, the period duration of the successive full cycles is always of the same magnitude. FIG. 2B shows a third example of a waveform of an advanced operating method, in which the period duration changes from full cycle to full cycle and the current waveform also changes from half-cycle to half-cycle. In such cases, the current profile is more complex and exhibits current boosts and staircase profiles which are synchronized with the sequence of the individual color segments of the color wheel. In the case of such complex current waveforms it is more difficult to operate the lamp optimally; for this purpose, it is necessary to observe some fundamental design rules when generating a waveform.

For stable and flicker-free operation, the temperature of the electrode should always be in a specific range, such that the electrode tip is indeed just liquid. The electrode tip is thus at the optimum temperature for a stable arc attachment. This is unproblematic in principle during operation of the lamp at nominal power and can be implemented with the known operating methods. However, if the lamp is intended to be greatly dimmed, that is to say operated at a power significantly lower than the nominal power, then the problem arises that the temperature of the electrodes decreases on account of the reduced lamp power, and flickering of the discharge arc occurs on account of the low temperature of the electrodes. If the lamp is intended to be operated with higher power, then the problem arises that the electrodes can become too hot and an increased electrode burn-back occurs. Furthermore, the increased temperatures compared with normal operation can result in denitrification of the burner vessel.

SUMMARY

Various embodiments provide a method for operating a high-pressure discharge lamp outside the nominal power range thereof, by means of which method the lamp can be operated reliably and does not incur damage.

Various embodiments provide a method for operating a high-pressure discharge lamp outside the nominal power range thereof, wherein at a lamp power of less than 85% of the nominal power or at a lamp power of greater than 110% of the nominal power one or more of the parameters lamp frequency, lamp current in a commutation pulse, lamp of the commutation pulse, and/or the commutation pattern are/is varied relative to operation at nominal power.

The operating method according to the invention allows high-pressure discharge lamps, in particular for projection applications, to be operated in an extended power range. The power range for projection lamps that has typically been attainable heretofore from the prior art is between 70%-85% and 110%-115% of the nominal power of the lamp for which the electrodes were dimensioned.

The mode of operation according to the invention makes it possible to operate high-pressure discharge lamps, in particular for projection applications, in the power range of preferably between 20% and 130% of the nominal power.

In principle, two cases can be differentiated here:

1) Extension of the power range to higher powers above the nominal power of the lamp: this range is limited by the fast burn-back of the electrodes and the more rapidly commencing devitrification of the gas discharge lamp burner. The problem mentioned first can be solved by the method according to the invention, but the devitrification problem still exists. Accordingly, operation in the power range of 110% to 130% should be allowed only for a short time, e.g. a maximum of 50 hours, depending on the type of lamp, since the devitrification generally cannot be permanently prevented with increased cooling.
2) Extension of the power range to lower powers below the nominal power of the lamp: this range is principally limited by electrodes that are operated too cold, and by flicker problems that occur as a result. These problems can be solved by the mode of operation according to the invention. In order to obtain an optimum effect of this mode of operation, the cooling of the lamp has to be adapted to the mode of operation. In video projectors, the lamp is cooled by an air flow, and the cooling effect can be set by means of the air throughput or the rotational speed of the fan, which reduces noise at a reduced rotational speed of the fan in dimmed operation. In the case of video projectors, the prior art discloses a so-called "eco mode", in which the lamp is operated in a slightly dimmed manner in order to save power and to ensure quieter operation of the projector and to lengthen the lifetime of the lamp if the full light power is not required. With the known methods from the prior art, however, the lamp could never be dimmed below 70% to 85%, since flickering of the lamp cannot be ruled out with the known methods. With the method according to the invention, however, a genuinely power-saving operating mode is possible, since the lamp can be dimmed down to as far as 20% of its nominal power. Moreover, the cooling requirement decreases further and thus also allows a further reduction of the disturbing noise level.

There are fundamental dependencies for the operating method according to the invention: if it is desired to change the power to more than 110% of the nominal power, the electrodes are thermally overloaded. Accordingly, the energy modulation has to be reduced. This can be achieved by the following individual measures, which, if appropriate, can also be combined with one another: decreasing the lamp frequency, decreasing the pulse height, decreasing the pulse width, and a suitable adaptation of the commutation pattern. In the case of changing the power to less than 85% of the nominal power, the electrodes become too cold and tend toward flicker. The power is dependent on the type of lamp; some types of lamp can also be dimmed to 70% of the nominal power using the known methods and the method according to the invention is necessary only below 70% of the nominal power. Accordingly, the energy modulation has to be increased. This can be achieved by means of the following individual measures, which, if appropriate, can also be combined with one another: increasing the lamp frequency, increasing the pulse height, increasing the pulse width, and a suitable adaptation of the commutation pattern.

Preferably, the following relationships hold true for example for the normalized lamp frequency $f_{LN}$ as a function of the normalized lamp power $P_{LN}$:

$$1.48 - 0.91P_{LN} \leq f_{LN} \leq 5.76 - 3.82P_{LN}$$

$$f_{LN} = \frac{f_L}{f_{nominal}};\ P_{LN} = \frac{P_L}{P_{nominal}};$$

wherein $f_L$ is the present lamp frequency and $f_{nominal}$ is the lamp frequency during nominal operation. Analogously, $P_L$ is the present lamp power and $P_{nominal}$ is the power during nominal operation. Nominal operation means that the high-pressure discharge lamp is operated with its power specified by the lamp manufacturer and within the operating parameters specified by the lamp manufacturer. An even more uniform electrode temperature can be achieved with this measure.

Further advantageous developments and configurations of the method according to the invention for operating a high-pressure discharge lamp outside the nominal power range thereof are evident from further dependent claims and from the following description.

BRIEF DESCRIPTION OF THE DRAWINGS

Further advantages, features and details of the invention are evident with reference to the following description of exemplary embodiments and with reference to the drawings, in which identical or functionally identical elements are provided with identical reference signs. In this case, in the figures.

DETALED DESCRIPTION

The following detailed description refers to the accompanying drawings that show, by way of illustration, specific details and embodiments in which the invention may be practiced.

Figure 1:
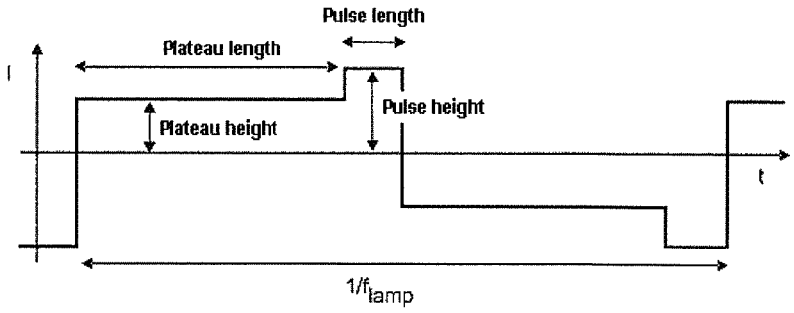
FIG. 1 shows a simple waveform with a commutation pulse according to the prior art.

FIG. 1 shows a simple waveform with a commutation pulse according to the prior art, such as is used for example for LCD projectors (LCD stands for Liquid Crystal Display). Some terms which are necessary for illustrating the invention are defined below with reference to this simple waveform.

The waveform is subdivided into full cycles and half-cycles, wherein the (average) length of a full cycle is defined as $1/(f_L)$ and the (average) length of a half-cycle is defined as $1/(2*f_L)$, wherein $f_L$ is the (average) frequency with which the lamp is operated, also called lamp frequency hereinafter. Simple symmetrical waveforms are distinguished by a single constant lamp frequency. The same applies to the length of the half-cycles and full cycles. Complex waveforms consist of half-cycles and full cycles having different lengths, such that for the latter only an average length and thus an average frequency can be specified.

The waveform has a commutation pulse, already described in the introduction, said commutation pulse being defined more specifically here by means of a pulse length and a pulse height. The rest of the half-cycle, which is not to be ascribed to the commutation pulse, is defined as a plateau, with an analogous definition of the plateau length and plateau height.

The pulse-plateau ratio is defined as the quotient of the pulse height with respect to the plateau height.

A duty cycle is defined as the quotient of the pulse length with respect to the length of a half-cycle. The duty cycle thus relates here to a half-cycle rather than to a full cycle. Therefore, the following then holds true: Duty Cycle=Pulse Length*2*$f_L$.

Figure 2A:
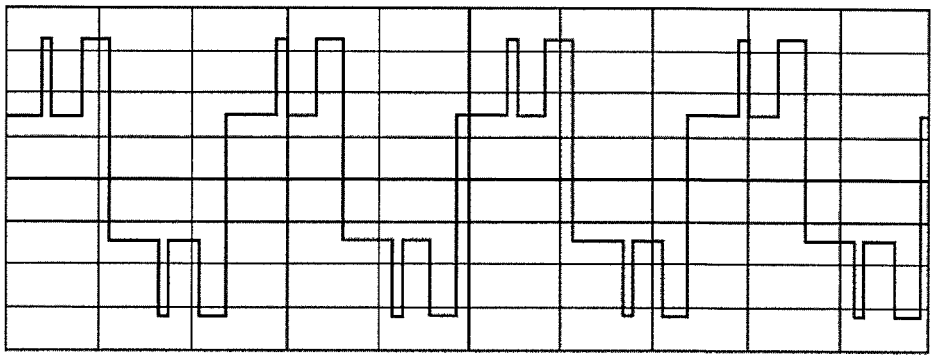
FIG. 2A shows a waveform with a commutation pulse and a further current boost and a predetermined frequency.

FIG. 2A shows a more complex waveform such as are employed in so-called DPL projectors (DLP stands for digital light processing). Here the current is often also modulated in the plateau of the half-cycle, the modulation being closely coordinated with the color wheel in the projector. Accordingly, the current curve appears to be more complicated than in FIG. 1, but the abovementioned definitions still hold true in principle. Owing to the current modulation in the plateau, the ratio of pulse current to RMS current rather than the pulse-plateau ratio is generally used for describing the relative pulse level.

$I_{RMS}=P_L/U_L$ is the thermal current or RMS current, which is set during control to the power $P_L$ by the operating device if the lamp has a voltage $U_L$.

Figure 2B:
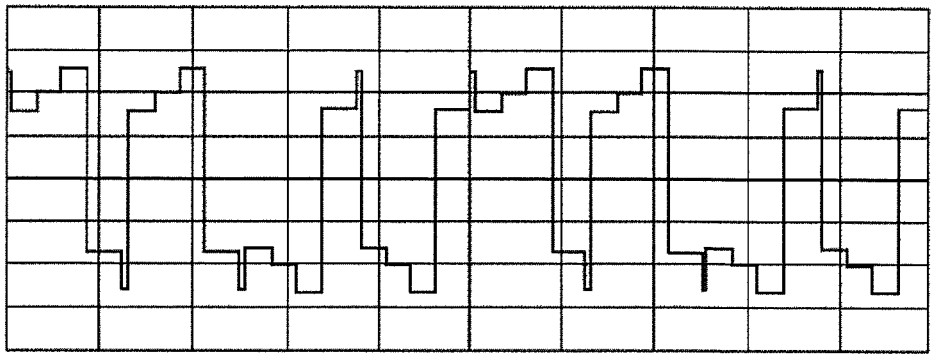
FIG. 2B shows a more complex waveform with changing frequency sections.

FIG. 2B shows a further complex current profile with a plurality of different current heights in the plateau region. Here the plateau region and the commutation pulse already merge fluidly into one another, such that a definition is not made very easily in some half-cycles.

The following table indicates the operating parameters to be optimized with their effective minimum and maximum values, as a multiple of the value at nominal power: by way of example, a frequency of 60 Hz at nominal power for the case "dimming to power P<85% of the nominal power" would result in an adaptation of the frequency within the limits 1.3*60 Hz=78 Hz and 5*60 Hz=300 Hz. The last row furthermore indicates how a suitable adaptation of the commutation pattern can be achieved.

| Optimization parameter | Parameter for P < 85% of the nominal power | Parameter for P > 110% of the nominal power |
|---|---|---|
| Frequency $F_L$ | × 1.3 – 5 | × 0.3 – 0.8 |
| Pulse height | × 1.2 – 3 | × 0.3 – 0.8 |
| Pulse width | × 1.2 – 3 | × 0.3 – 0.8 |
| Commutation pattern | Shift commutation of small pulses to large pulses | Shift commutation of large pulses to small pulses or even to regions of the current curve without a pulse |

The lower the lamp power, the greater the lamp frequency and, if appropriate, the pulse height and/or the pulse width of the commutation pulse should be. The commutation should preferably be shortly after such a commutation pulse since, at this point in time, the electrode is hot enough to be able to ensure a clean and flicker-free commutation. By contrast, the higher the lamp power, the smaller the lamp frequency and, if appropriate, the pulse height and/or the pulse width of the commutation pulse should be. The commutation should take place in regions of the current curve in which only small, if appropriate even no pulses at all are applied to the high-pressure discharge lamp, in order that the electrodes are not too hot during commutation.

Figure 3A:
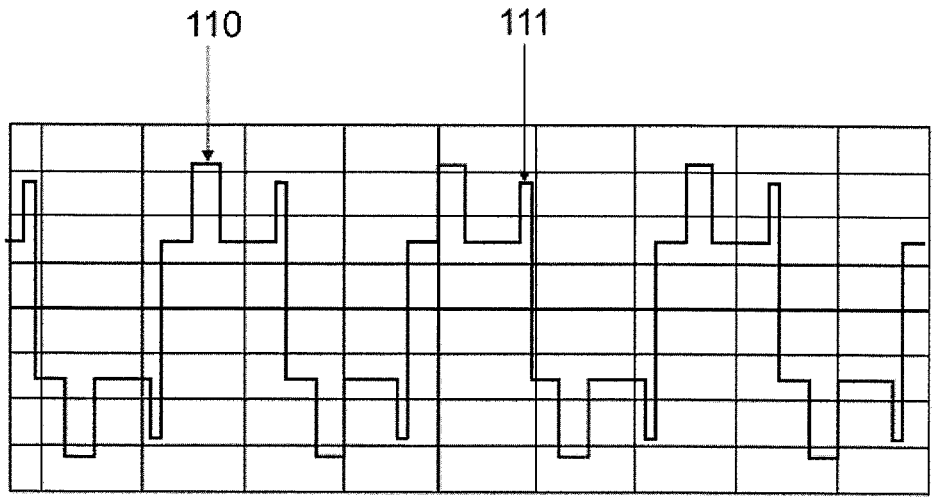
FIG. 3A shows a waveform for the nominal operation of the high-pressure discharge lamp.
Figure 3B:
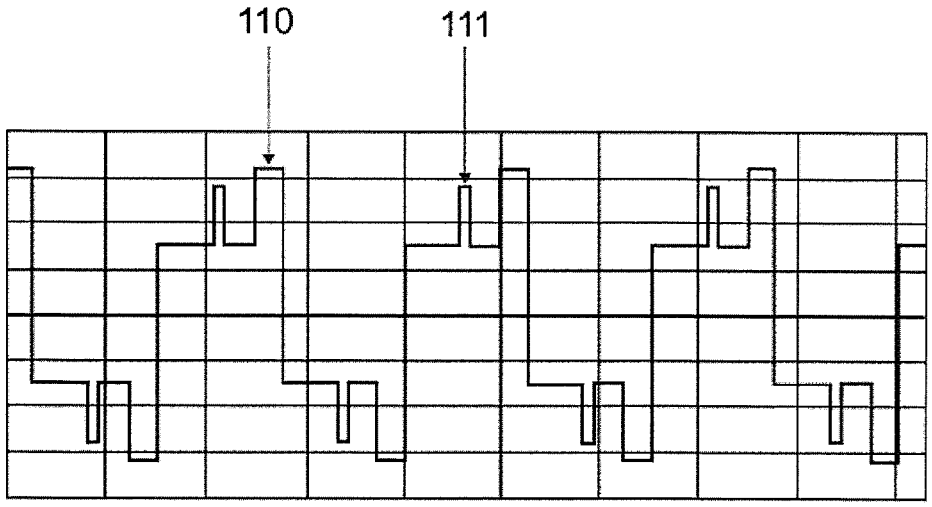
FIG. 3B shows a waveform for the dimmed operation of the high-pressure discharge lamp.

One example of an optimization of the waveform with regard to the commutation pattern for dimmed operation of the high-pressure discharge lamp is shown in FIGS. 3A and 3B. In FIG. 3A, which shows a waveform for the nominal operation of the high-pressure discharge pump, the waveform has a current boost 110 in the plateau and a commutation pulse 111 shortly before the commutation. For dimmed operation below 85% of the nominal power, the commutation pulse 111 is too small; it should satisfy the criteria in accordance with the table above. However, it cannot be enlarged arbitrarily without altering the color rendering of the lamp in an undesired manner. Therefore, as shown in FIG. 3B, the commutation is shifted: the current boost 110 in the waveform in FIG. 3A therefore becomes the commutation pulse 110 in FIG. 3B, and the previous commutation pulse 111 in FIG. 3A is then only a current boost 111 in FIG. 3B, after which commutation does not take place. Thus, the essential parameters for the lamp remain the same, but the electrodes are suitably heated before commutation, such that the commutation itself becomes unproblematic. Precisely this procedure can also be adopted in the case of excess power. Here the commutation is shifted from regions of high current to regions having lower lamp current, in order to avoid excessive melting of the electrode tips and, if appropriate, also a blackening of the lamp bulb as a result of the material removal on the electrode on account of the high current.

Figure 4:
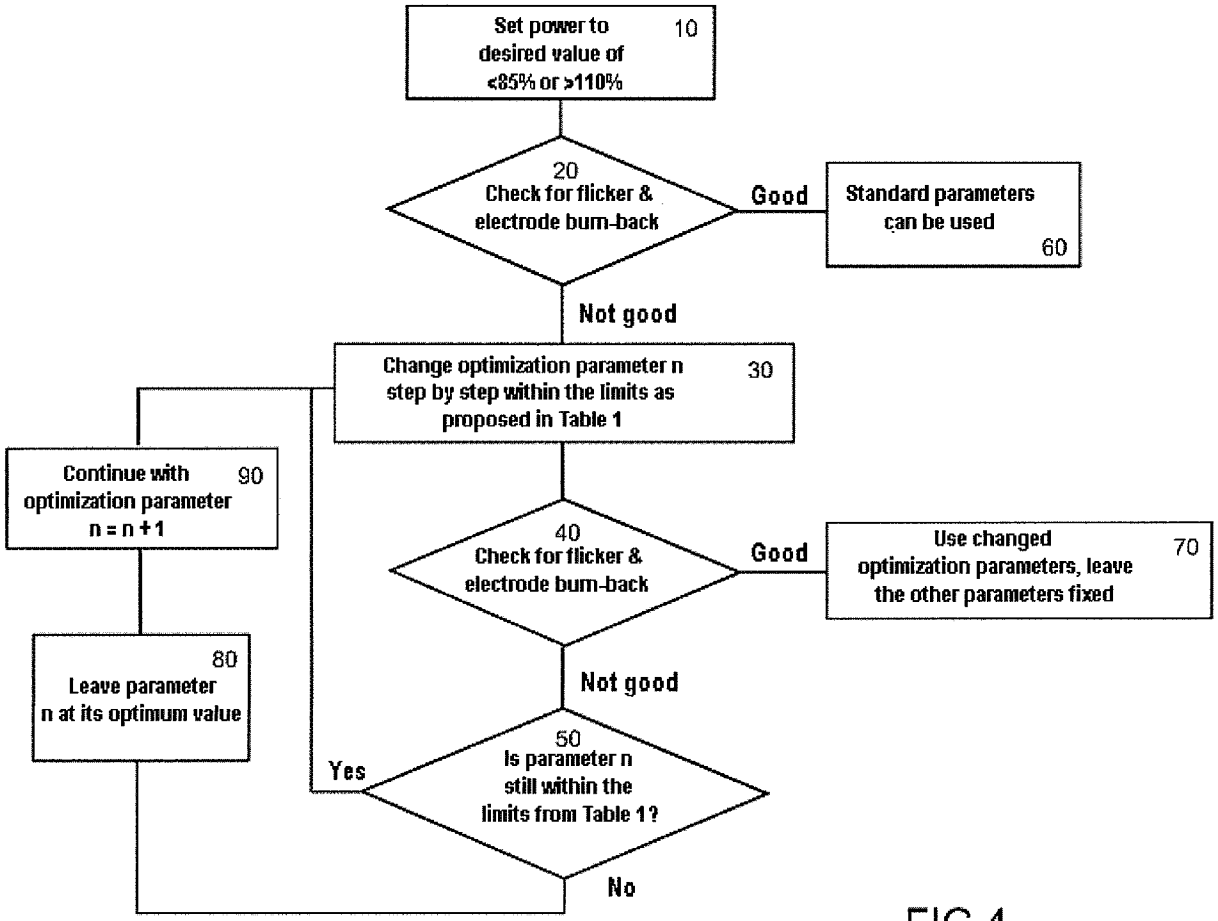
FIG. 4 shows a flow chart of the method according to the invention for operating a high-pressure discharge lamp outside the nominal power range thereof.

FIG. 4 shows a flow chart of the method according to the invention for operating a high-pressure discharge lamp outside the nominal power range thereof. At the start point, in step 10, the lamp power is set to a corresponding range of less than 85% or greater than 110% of the nominal lamp power. In step 20, a check is then made to determine whether the lamp tends toward flicker or exhibits excessive electrode burn-back. This can be assessed by an operating device that implements the method according to the invention, e.g. on the basis of the variation of the lamp voltage. If the lamp voltage does not exhibit any conspicuous attributes, then the normal waveform is maintained further for nominal operation in step 60.

If conspicuous attributes are manifested, then proceeding from the standard waveform, in step 30 the optimization parameter n is modified step by step and in step 40 a check is made a second time to determine whether the lamp tends toward flicker or the electrodes tend toward burn-back. If this is the case, then in step 50 a check is made to determine whether the parameter is already outside the range in accordance with the table above. If this is not the case, then the method jumps back to step 30 and the parameters are varied further there. If this is the case, then said parameter is not varied further. The parameter counter n is incremented by one and the method jumps to step 30, in which the next parameter is then varied step by step. If no anomalies are measured in step 40, then the lamp is operated with this set of parameters in step 70.

The optimization parameters to be processed in order are indicated in the following table:

| Optimization parameter n (order) | LCD application | Additional restrictions (LCD) | DLP application | Additional restrictions (DLP) |
|---|---|---|---|---|
| 1 | Frequency $f_L$ | Generally none | Frequency $f_L$ | For example commutations possible only in the case of color change, essentially commutation possible in the white segment of the color wheel |
| 2 | Pulse height | Generally none | Commutation pattern | Generally none |
| 3 | Pulse width | Generally none | Pulse height | For example in the case of pulses in color segments, influence on the color mixing: if appropriate, adaptation necessary in the application, no problem in the white segment. |
| 4 | Commutation pattern | Generally none | Pulse width | For example only extension to a complete adjacent color segment. Thus influence on color mixing in the application, if appropriate adaptation necessary. |

In this case, a distinction is made between the different technologies of LCD and DLP in video projectors.

In LCD video projectors, the white light from the lamp is decomposed into the three primary colors red, green and blue by dichroic mirrors. The light is subsequently guided through the LCD panels, which stipulate for each individual image pixel whether the light can pass or is absorbed. Finally, the light is combined again by means of a prism.

The advantage of this technology is that all relevant operating parameters are adjustable in wide ranges since any change simultaneously affects all three colors. The balance between the colors is thus maintained.

In DLP video projectors, the white light from the lamps is successively decomposed into the individual primary colors red, green and blue by a color wheel. Each individual pixel is subsequently driven by the DMD (digital mirror device), by means of movable mirrors. In this system, there are distinctly more restrictions for the operating method according to the invention: a first restriction is that the lamp must run synchronously with the color wheel. Therefore, changes in the frequency are possible only in a restricted manner, e.g. multiple or integral fractions of the color wheel frequency, commutations only in the spoke (at the boundary) between the color segments. The second restriction is the sequential processing of the light. If, in the red color wheel segment, for example, a current pulse is driven in a waveform according to the invention in order to raise the proportion of red in the light, then that has to be correspondingly taken into account in the control of the color balance. This is often effected in the context of the control software for the DMD chip. If this pulse in the red is now increased or widened, then the color matching is no longer correct and the image acquires a red cast. Therefore, such a change in the operating scheme is only expedient if a change in the color matching in the DMD were also to take place at the same time as the change in the pulse.

Technically advanced DLP systems have three DMD components, one for each primary color. 3-chip devices thus function in a similar manner to LCD devices, in the sense that all three primary colors are processed in parallel.

Figure 5:
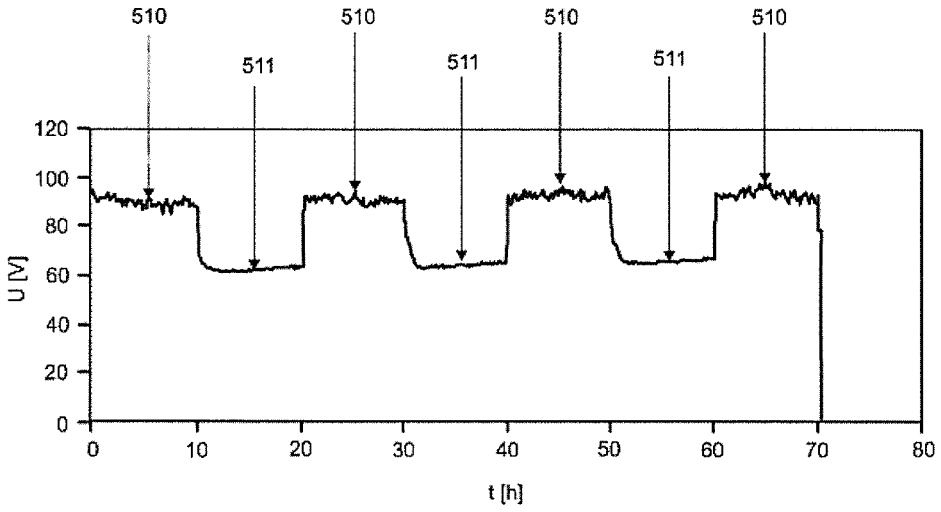
FIG. 5 shows an example of operation of a high-pressure discharge lamp having a nominal power of 330 W at 200 W (=60.6% of the nominal power) and in two different operating modes.

FIG. 5 shows the operation of a high-pressure discharge lamp having a nominal power of 330 W at 200 W, corresponding to 60.6% of the nominal power of the high-pressure discharge lamp. The 330 W high-pressure discharge lamp is operated continuously at 200 W, although in alternation between two different operating modes: in mode 1, provided with the reference sign 510 in FIG. 4, the high-pressure discharge lamp is operated with the same scheme as at nominal power, except with 200 W instead of 330 W. In this case, the tip that is melted slightly at nominal power solidifies and can therefore release electrons only in a restricted manner. Accordingly, the voltage is approximately 30 V higher in comparison with mode 2, bearing the reference signs 511, in which frequency and pulse height were adapted by the method described above. In mode 1, besides a voltage that overall is higher by approximately 30 V, a distinctly visible fluctuation of the running voltage can also be seen. This distinctly visible fluctuation of the running voltage is manifested optically in flicker of the high-pressure discharge lamp as a reaction to the solidified electrode tip.

Flicker detection can therefore take place in the case of a high degree of dimming of less than 85% of the nominal power by means of the running voltage of the lamp. In addition, a direct observation of the arc attachment by means of a suitable projection optical unit may be expedient.

Such a mode of operation can also be used to operate a high-pressure discharge lamp having a high nominal power permanently with a significantly lower power, in order to increase the lifetime of said lamp. This is normally not possible since the electrodes then become too cold and the lamp may be extinguished or flicker during commutation. This can be realized by the method according to the invention since the electrodes can be correspondingly heated before commutation, and the average power can nevertheless be reduced. In order to ensure stable operation, however, flicker detection is necessary. However, the latter can be in the form of an electrical circuit, in particular in the form of additional software for a digitally operated circuit arrangement, such that no or only few additional costs arise for the circuit arrangement.

Figure 6:
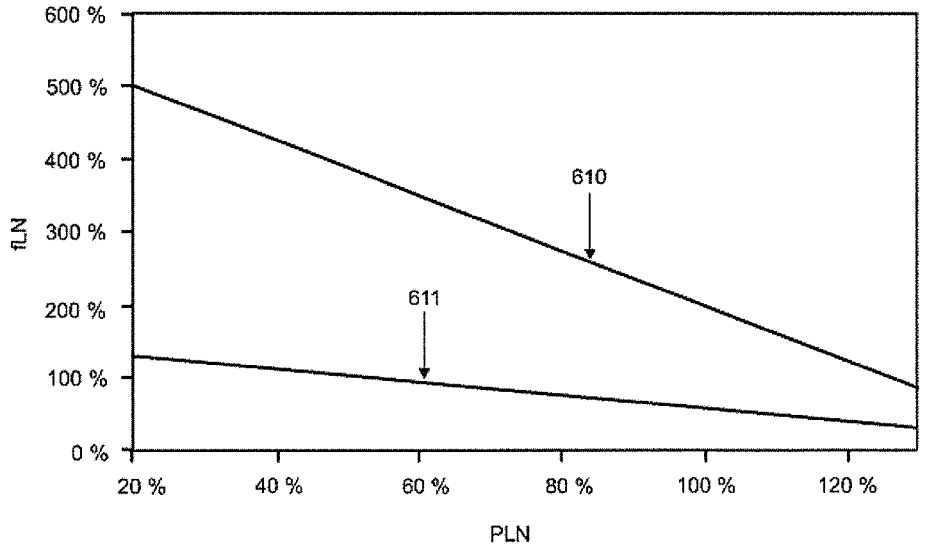
FIG. 6 shows the dependence of the lamp frequency on the lamp power relative in each case to the lamp frequency and respectively the lamp power in nominal operation.

FIG. 6 shows the dependence of the lamp frequency on the lamp power relative in each case to the lamp frequency and respectively the lamp power in nominal operation. This dependence is expedient in a range between a curve 610 for the upper limit and a curve 611 for the lower limit. The range within these two curves can therefore be used for optimizing the lamp frequency. One exemplary dimensioning for the lamp frequency $f_L$ as a function of the lamp power $P_L$ is e.g. the following relationship already mentioned in the introduction: $1.48-0.91\ P_{LN} \leq f_{LN} \leq 5.67-3.82\ P_{LN}$; wherein $f_{NL}$ is the normalized lamp frequency and $P_{LN}$ is the normalized power. However, any other relationship lying within the curve 611 for the lower limit and the curve 610 for the upper limit is also conceivable.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SIGNS

110, 111 Current boost/commutation pulse
510 Operating mode 1 with conventional values for the operating parameters of lamp frequency and lamp pulse height
511 Operating mode 2 with operating parameters of lamp frequency and lamp pulse height adapted according to the invention.
610 Curve for the upper frequency limit
611 Curve for the lower frequency limit

The invention claimed is:

1. A method for operating a high-pressure discharge lamp outside the nominal power range thereof, the method comprising:
providing the high-pressure discharge lamp; and
varying relative to operation at nominal power, at least one of the following parameters at one of either less than 85% of the nominal power or greater than 110% of the nominal power:
lamp frequency,
lamp current in a commutation pulse,
length of the commutation pulse,
the commutation pattern, and
wherein at a lamp power of less than 85% of the nominal power the high-pressure discharge lamp is operated with a lamp frequency which corresponds to 1.3 times to 5 times the lamp frequency at nominal power.

2. The method as claimed in claim 1,
wherein at a lamp power of between 20% and 60% of the nominal power the high-pressure discharge lamp is operated with a lamp frequency which corresponds to 1.3 times to 3.5 times the lamp frequency at nominal power.

3. The method as claimed in claim 1,
wherein at a lamp power of less than 85% of the nominal power the high-pressure discharge lamp is operated with a commutation pulse height which corresponds to 1.2 times to 3 times the commutation pulse height at nominal power.

4. The method as claimed in claim 1,
wherein at a lamp power between 20% and 60% of the nominal power the high-pressure discharge lamp is operated with a commutation pulse height which corresponds to 1.2 times to 3 times the commutation pulse height at nominal power.

5. The method as claimed in claim 1,
wherein at a lamp power of less than 85% of the nominal power the high-pressure discharge lamp is operated with a pulse width of the commutation pulse which corresponds to 1.2 times to 3 times the pulse width of the commutation pulse at nominal power.

6. The method as claimed in claim 1,
wherein at a lamp power between 20% and 60% of the nominal power the high-pressure discharge lamp is operated with a pulse width of the commutation pulse which corresponds to 1.2 times to 3 times the pulse width of the commutation pulse at nominal power.

7. The method as claimed in claim 1,
wherein at a lamp power of less than 85% of the nominal power the commutation of the lamp current of the high-pressure discharge lamp is shifted in such a way that it takes place after higher-energy current pulses.

8. The method as claimed in claim 1,
wherein at a lamp power of greater than 110% of the nominal power the high-pressure discharge lamp is operated with a lamp frequency which corresponds to 0.3 times to 0.8 times the lamp frequency at nominal power.

9. The method as claimed in claim 1, wherein at a lamp power of greater than 110% of the nominal power the high-pressure discharge lamp is operated with a commutation pulse height which corresponds to 0.3 times to 0.8 times the commutation pulse height at nominal power.

10. The method as claimed in claim 1, wherein at a lamp power of greater than 110% of the nominal power the high-pressure discharge lamp is operated with a pulse width of the commutation pulse which corresponds to 0.3 times to 0.8 times the pulse width of the commutation pulse at nominal power.

11. The method as claimed in claim 1, wherein at a lamp power of greater than 110% of the nominal power the commutation of the lamp current of the high-pressure discharge lamp is shifted from ranges of high lamp current to ranges having lower lamp current.

12. The method as claimed in claim 1, wherein the following relationship holds true for the lamp frequency $f_L$ as a function of the lamp power $P_L$:

$$1.48 - 0.91P_{LN} \leq f_{LN} \leq 5.76 - 3.82P_{LN};$$

$$f_{LN} = \frac{f_L}{f_{nominal}};\ P_{LN} = \frac{P_L}{P_{nominal}};$$

wherein $f_L$ is the present lamp frequency, $P_L$ is the present lamp power, $f_{nominal}$ is the lamp frequency and $P_{nominal}$ is the power during nominal operations.

* * * * *

UNITED STATES PATENT AND TRADEMARK OFFICE

CERTIFICATE OF CORRECTION

PATENT NO. : 9,204,520 B2
APPLICATION NO. : 13/814268
DATED : December 1, 2015
INVENTOR(S) : Magg It is certified that error appears in the above-identified patent and that said Letters Patent is hereby corrected as shown below:

In the specification

Column 3, line 45 delete "denitrification" between the words "in" and "of", and insert --devitrification-- in place thereof.

In the claims

Column 12, line 16 delete "operations", and insert "operation" in place thereof.

Signed and Sealed this
Fourteenth Day of June, 2016

Michelle K. Lee

Michelle K. Lee
*Director of the United States Patent and Trademark Office*